US005749097A

United States Patent [19]

Garrett-Roe

[11] Patent Number: 5,749,097

[45] Date of Patent: May 12, 1998

[54] THREE DIGIT FINGERNAIL PROTECTOR

[76] Inventor: Anita Mallory Garrett-Roe, 1400 Ocean Dr., No. 802B, Corpus Christi, Tex. 78404

[21] Appl. No.: 813,436

[22] Filed: Mar. 10, 1997

[51] Int. Cl.[6] ..... A41D 13/00

[52] U.S. Cl. ..... 2/21

[58] Field of Search ..... 2/21, 17, 19, 20, 2/160, 159, 161.1, 161.6, 163

[56] References Cited

U.S. PATENT DOCUMENTS

| | | | |
|---|---|---|---|
| 1,416,001 | 5/1922 | Ditwiler | 2/21 |
| 1,483,595 | 2/1924 | Read | 2/21 X |
| 1,642,311 | 9/1927 | Richardson | 2/21 X |
| 1,783,984 | 12/1930 | Shane . | |
| 4,689,828 | 9/1987 | Brewer | 2/21 |
| 4,733,410 | 3/1988 | Glotkin | 2/21 |
| 4,751,747 | 6/1988 | Banks et al. | 2/21 |
| 4,796,302 | 1/1989 | Davis et al. | 2/21 |

*Primary Examiner*—C. D. Crowder
*Assistant Examiner*—Shirra L. Jenkins
*Attorney, Agent, or Firm*—Terrance L. Siemens

[57] ABSTRACT

A finger and thumb protector providing two sheaths for fingers and one sheath for the thumb of a user working with solvents. The sheaths are connected by a tether. The protector is formed from a thin, flexible, elastic material impervious to solvents, such as polyvinyl chloride. Two sheaths for fingers are disposed parallel, abutting, and open in similar directions. The sheath for the thumb is angled with respect to the sheaths for fingers, thereby assuming positions natural for a closed grasp of a small object. Each sheath is generally cylindrical, domed at the closed end, and extends to the first knuckle of its respective finger or thumb. The tether is U-shaped, with the U-shaped channel open in a direction similar to those of the finger and thumb sheaths. The protector may be fabricated by dipping a mold into liquid, uncured resin and peeling the protector from the mold after curing of the material.

7 Claims, 2 Drawing Sheets

THREE DIGIT FINGERNAIL PROTECTOR

BACKGROUND OF THE INVENTION

1. Field of the Invention

The present invention relates to protective apparatus for the hands, and more particularly, to a guard worn on two fingers and the thumb of one hand. The guard provides sheaths for the fingers and thumb. The sheaths are connected, so that the resultant guard comprises a unitary component.

2. Description of the Prior Art

When nail technicians render manicuring services to clients, it is frequently necessary to remove existing nail polish from the fingernails of the client. Liquid solvents are applied to dissolve the existing dry polish. It is extremely difficult to control liquid solvents against spattering and running. Therefore, polish on the nails of the technician is susceptible to fouling. The existing coat of polish may become streaked, spotted, and otherwise spoiled in appearance.

There exists a need for a protector for the thumb and fingers of nail technicians engaged in nail services. It would be sufficient to protect the thumb and adjacent two fingers from contact with solvents. A three fingered guard would address this need. A three fingered guard is shown in U.S. Pat. No. 4,751,747, issued to Janice Banks et al. on Jun. 21, 1988. However, unlike the present invention, the guard of Banks et al. covers the fingernails and finger tips with a stretchable fabric. By contrast, corresponding areas are covered in the present invention by solvent resistant material. The guard of Banks et al. is not readily transferrable from right to left hands. By contrast, the novel protector is so transferable. Banks et al. provide separated finger sheaths, whereas the finger sheaths of the present invention abut one another.

Another multi-finger guard is shown in U.S. Pat. No. 4,796,302, issued to Charles L. Davis et al. on Jan. 10, 1989. This guard has only two protective sheaths, unlike the three of the present invention. The guard of Davis et al. protects fingers from impacts, and fails to suggest composition of the finger sheaths from a material impervious to solvents. The guard of Davis et al. is also not transferrable from right to left hands.

U.S. Pat. No. 1,783,984, issued to Minnie V. Shane on Dec. 9, 1930, and U.S. Pat. No. 4,733,410, issued to Ruth E. Glotkin on Mar. 29, 1988, illustrate single digit guards. These devices lack three united sheaths for three digits, as seen in the present invention. There is no suggestion in these patents of protection against solvents.

None of the above inventions and patents, taken either singly or in combination, is seen to describe the instant invention as claimed.

SUMMARY OF THE INVENTION

The present invention provides a protector suited for protecting coats of polish of the finger nails of a nail technician working with liquid solvents from damage. The protector has three sheaths for digits, each digit extending from the tip of the thumb or finger to the first knuckle. Two finger sheaths are disposed parallel and abutting one another. This relationship is most natural for performing tasks encountered while performing tasks related to nail services. Of course, the finger sheaths could be spaced apart to a small extent, if desired.

The third sheath is spaced apart from the first two sheaths, and forms an angle with respect to the first two sheaths. This angle promotes ease of grasping objects. Since sheathing finger and thumb tips reduces tactile sensations and feedback, it is easy for the user to inadvertently relax his or her grasp of objects.

The protector is fabricated from a flexible material which is impervious to solvents used for dissolving nail polish. Polyvinyl chloride has proved a suitable material. The protector comprises a thin, flexible skin of constituent material, and is homogeneous throughout in that there are no areas of different constituency. This characteristic renders the novel protector easy to fabricate.

The sheath for the thumb is attached to the remaining sheaths by a channel which is U-shaped in cross section. The channel opens in the same direction as that of the sheaths. Both the several sheaths and the channel may be formed around a mold having only convex and planar surfaces. It is therefore highly practical to fabricate the novel sheath by dipping a mold into liquid resin, curing the resin, and peeling the resultant sheath from the mold. Thus, necessity of more expensive injection molding is obviated.

The resultant protector is resiliently elastic so as to fit snugly over a person's fingers and accommodating fingers of different dimensions. Elastically resilient snug fit promotes tactile sensations from being transferred, thereby enhancing grasp and manipulation of objects. The protector is easily donned and doffed by peeling. Flexibility enables the protector to be transferred between and worn on right and left hands. It may be thoroughly cleaned since it may be turned inside out for washing.

Accordingly, it is a principal object of the invention to provide a protective guard for protecting coats of nail polish of fingernails of a wearer against damage from solvents being utilized by the wearer.

It is another object of the invention that the protective guard cover finger and thumb tips up to the first knuckle of the respective digits.

It is a further object of the invention to promote ease of grasping objects by the fingers when wearing the protective guard.

Still another object of the invention is that the protector be homogeneous in consistency.

An additional object of the invention is that the protector fit snugly on each protected digit.

It is again an object of the invention that the protector be thin, flexible, and resilient, so that it may be peeled from an object and readily turned inside out.

Still another object of the invention is that the novel protector be fabricated from a dipping process rather than requiring injection molding.

Yet another object of the invention is that the protector be transferrable between right and left hands.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
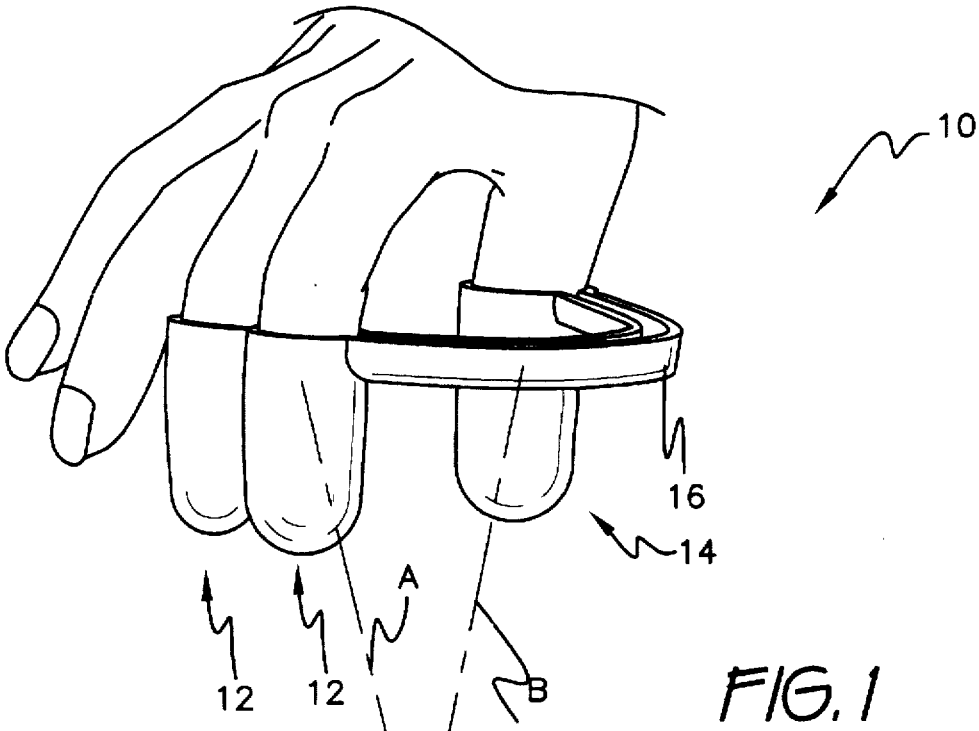
FIG. 1 is an environmental, perspective view of the invention.

Turning now to FIG. 1 of the drawings, the novel protector 10 is shown donned on the digits of the hand of a person who may be working with solvents (not shown). Protector 10 is seen to comprise two generally cylindrical, mutually open and abutting first sheaths 12 for enclosing two fingers and a second sheath 14 for enclosing the thumb. A flexible tether 16 connects sheath 14 to a sheath 12.

One sheath 12 is seen to have a first longitudinal axis A, while sheath 14 has a second longitudinal axis B. Axes A and B intersect at a point C, which may be said to face the distal closed ends 22, 24 (see FIG. 2) of sheaths 12, 14. This relationship causes sheath 14 to be of angled orientation relative to sheaths 12. Sheaths 12 and 14 are thus advantageously disposed to promote grasp of an object (not shown) between a finger and the thumb of a user.

Figure 2:
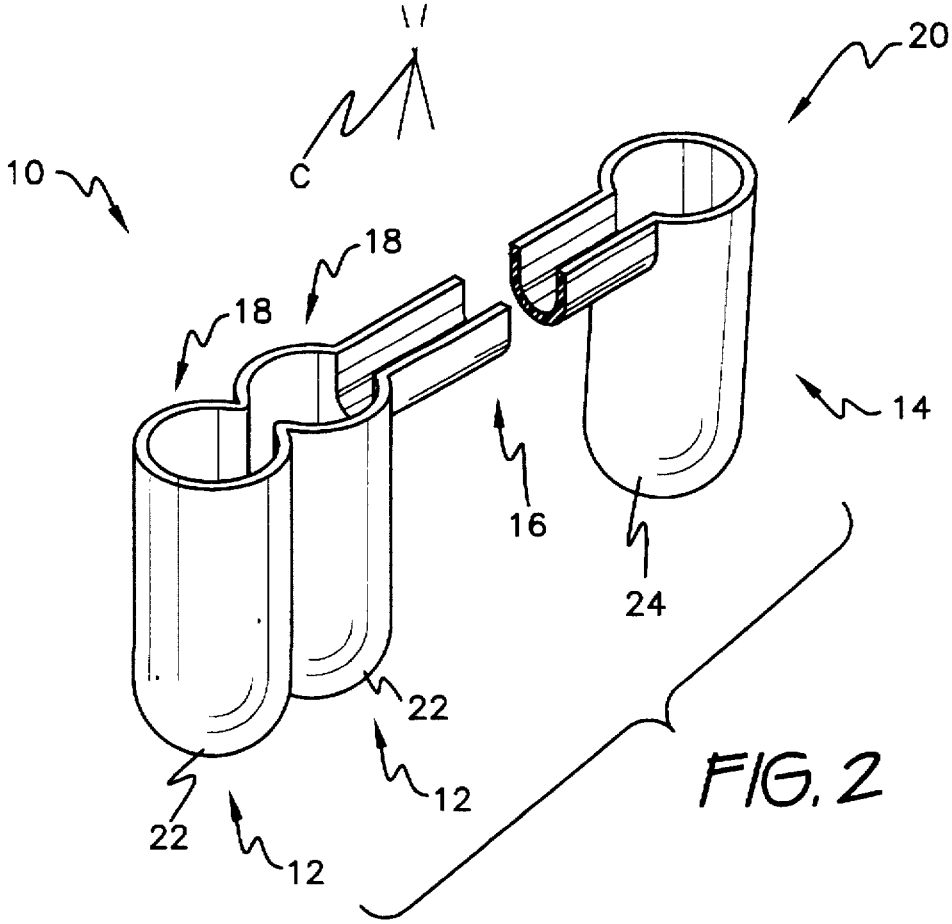
FIG. 2 is a perspective view of the invention, partially broken away to reveal internal detail.

As better seen in FIG. 2, each sheath 12 or 14 has a proximal open end 18 or 20 (respectively) and a distal closed end 22 or 24 (respectively). Tether 16 is clearly seen to comprise a U-shaped member, referring to the cross section in this view. The U-shaped member opens upwardly, in the same general direction as proximal open ends 18, 20 of sheaths 12, 14. This construction causes tether 16 to exhibit a tendency to resist spontaneously slumping, thereby encouraging protector 10, even though formed of a thin, flexible material, to maintain its configuration. This construction also enables protector 10 to be fabricated by dipping a mold into a liquid constituent material, as will be further described hereinafter.

Figure 3:
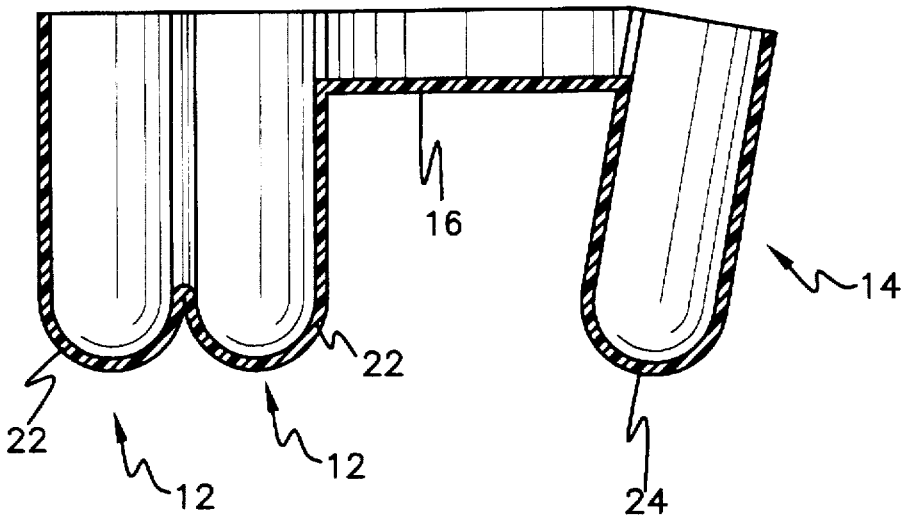
FIG. 3 is a side elevational, cross sectional view of the invention.

Referring now to FIG. 3, protector 10 is seen to be fabricated from a thin, elastic, flexible material such as polyvinyl chloride, which is resistant to solvents utilized in nail polish removal, such as acetone and presents the fingers of the hand from becoming wet. These properties enable protector 10 to fit snugly on and to elastically constrict about the fingers and thumb of a user. Tactile sensations for guiding the work are conducted through the material of sheaths 12, 14 to the fingers and thumb of the user.

Each sheath 12 or 14 extends from the tip of each respective enclosed digit to the first knuckle of each digit (see also FIG. 1). Each sheath 12 or 14 terminates at the first knuckle.

Each sheath 12 or 14 is seen to have a cylindrical, domed body of continuous, imperforate construction. The domed end is the same as the closed, distal ends 22, 24. This configuration conforms generally to fingers, and is judged to be comfortable and susceptible to ready fabrication of a suitable mold for fabrication.

Figure 4:
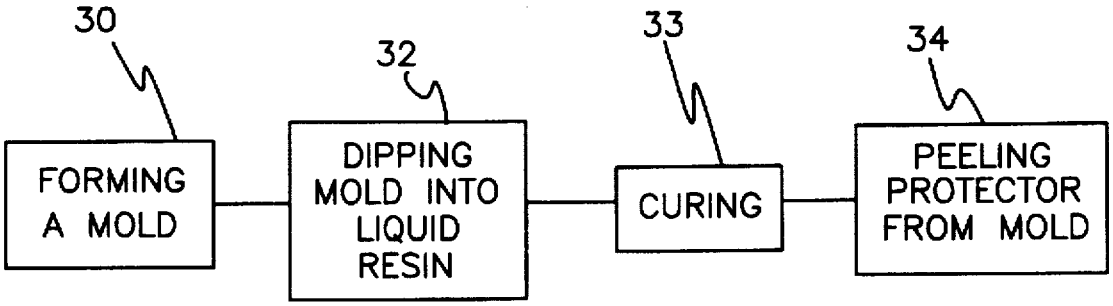
FIG. 4 is a block diagram summarizing steps of a method of fabricating the novel finger protector.

Fabrication is expeditiously performed by the following procedure, steps of which are summarized in FIG. 4. In a first step 30, a suitable mold is formed to include only convex and planar surfaces. A suitable mold (not shown) would have similar outer configuration as protector 10 (see FIG. 2), except that cavities formed in protector 10 for receiving fingers and thumb, and that formed in tether 16 could be filled in the mold.

In a second step 32, the mold is dipped in to a liquid, uncured resin or corresponding material. The mold thereby acquires a thin coat of this resin or material.

In a third step 34, the thin coat of material is allowed to cure into a thin skin on the mold. This may require that the mold be removed from the liquid, uncured material.

In a final step 36, the cured protector may then be removed from the mold. This step is preferably performed by peeling the protector from the mold. Of course, other methods may be employed, such as suction by vacuum or even by dissolving the mold.

The present invention is susceptible to variations and modifications from the embodiments and method of fabrication described above. For example, the number of sheaths may be varied to suit. A protector may thus be arranged to protect two, three, or four fingers, in addition to or in the absence of the thumb. Spacing of sheaths 12 from one another or from sheath 14 may also be varied. Angular relationship between sheaths 12 or between sheaths 12 and 14 may be adjusted.

It is to be understood that the present invention is not limited to the embodiments described above, but encompasses any and all embodiments within the scope of the following claims.

I claim:

1. A protector for digits of the hand of a person working with solvents, comprising:

a plurality of cylindrical, mutually open and abutting first sheaths each having a first proximal open end and a first distal closed end;

a second sheath having a second proximal open end and a second distal closed end; and a flexible tether connecting said second sheath to said first sheaths, said protector fabricated from a flexible material which is resistant to solvents and prevents the digits of the hand from becoming wet.

2. The protector according to claim 1, all of said first sheaths being oriented to open in the same direction.

3. The protector according to claim 2, said tether comprising a U-shaped member open in the same direction as that of said first sheaths, whereby said protector may be fabricated by dipping a mold in liquid, uncured material and peeling said protector from the mold after the liquid, uncured material has cured, while said tether exhibits a tendency to resist slumping.

4. The protector according to claim 2, at least one said first sheath having a first longitudinal axis and said second sheath having a second longitudinal axis intersecting said first second longitudinal axis at a point facing said first distal closed ends of said first sheaths and also facing said second distal closed end of said second sheath, said second sheath being of angled orientation relative to said first sheaths, whereby said first sheaths and said second sheaths are advantageously disposed to promote grasp of an object between a finger and the thumb of a user.

5. The protector according to claim 1, said first sheaths and said second sheath being formed from a thin, elastic material, whereby said first sheaths and said second sheath fits snugly on the fingers and thumb of a user and tactile sensations are conducted through said first sheaths and said second sheaths to the fingers and thumb of the user.

6. The protector according to claim 1, said first sheath and said second sheath extending from the tip of each enclosed digit of a user to the first knuckle of each digit and terminating at the first knuckle, each said first sheath and said second sheath having a cylindrical, domed body of continuous, imperforate construction.

7. A protector for digits of the hand of a person working with solvents, comprising:

a plurality of cylindrical, mutually abutting first sheaths each having a first proximal open end and a first distal closed end, all of said first sheaths being oriented to open in the same direction;

a second sheath having a second proximal open end and a second distal closed end, at least one said first sheath having a first longitudinal axis and said second sheath having a second longitudinal axis intersecting said first second longitudinal axis at a point facing said first distal closed ends of said first sheaths and also facing said second distal closed end of said second sheath, said second sheath being of angled orientation relative to said first sheaths, whereby said first sheaths and said second sheaths are advantageously disposed to promote grasp of an object between a finger and the thumb of a user, said first sheath and said second sheath extending from the tip of each enclosed digit of a user to the first knuckle of each digit and terminating at the first knuckle, each said first sheath and said second sheath having a cylindrical, domed body of continuous, imperforate construction; and a flexible tether connecting said second sheath to said first sheaths, comprising a U-shaped member open in the same direction as that of said first sheaths, whereby said protector may be fabricated by dipping a mold in liquid, uncured material and peeling said protector from the mold after the liquid, uncured material has cured, while said tether exhibits a tendency to resist slumping, said protector fabricated from a thin, elastic, flexible material resistant to solvents, whereby said first sheaths and said second sheath fits snugly on the fingers and thumb of a user and tactile sensations are conducted through said first sheaths and said second sheaths to the fingers and thumb of the user.

* * * * *